US007281450B1

(12) United States Patent
Weinraub

(10) Patent No.: US 7,281,450 B1
(45) Date of Patent: Oct. 16, 2007

(54) UNLOCKING TOOL FOR VEHICLE DOORS

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 11/602,649

(22) Filed: Nov. 21, 2006

(51) Int. Cl.
*E25B 19/20* (2006.01)

(52) U.S. Cl. ..... 81/15.9; 81/488

(58) Field of Classification Search ..... 81/15.9, 81/488; 70/465; 294/19.1; 29/278
See application file for complete search history.

(56) References Cited

U.S. PATENT DOCUMENTS 3,208,302 A * 9/1965 Lewis et al. ..... 74/548
4,086,718 A * 5/1978 Swanson et al. ..... 43/17.2
4,836,061 A * 6/1989 Weinraub ..... 81/15.9
D349,748 S * 8/1994 Lucero ..... D22/139
5,988,712 A * 11/1999 Segelin ..... 292/346
6,145,235 A * 11/2000 Emerson et al. ..... 42/90
6,360,637 B1 * 3/2002 Weinraub ..... 81/488
6,591,473 B1 * 7/2003 Child ..... 81/15.9

* cited by examiner

*Primary Examiner*—Hadi Shakeri
(74) *Attorney, Agent, or Firm*—Harold L. Jackson

(57) ABSTRACT

Vehicle unlocking tool for unlocking vehicle doors from the outside of the vehicle comprises at least two rod sections which are coupled together one rod section having a handle for manipulating the overall rod tool and the other rod section having an end portion that is used to push or pull or otherwise manipulate a lock actuator. The first rod section is stiffer than the second rod section which is made to be flexible to avoid scratching the interior of the car, such as the door panels, seats or dash but still has sufficient stiffness to transfer the force necessary to unlock the door. Additional sections may be added to the rod to lengthen its reach as needed by the tool operator.

8 Claims, 6 Drawing Sheets

UNLOCKING TOOL FOR VEHICLE DOORS

FIELD OF THE INVENTION

This invention relates generally to devices for enabling keyless entry into locked vehicles and more particularly to an elongated tool for opening a locked vehicle door which operationally engages door lock actuators inside the vehicle compartment.

BACKGROUND OF THE INVENTION

Many occasions exist in which legal entry into a locked vehicle is desired or necessary without the use of a key. This can occur because the keys may have been left inside the vehicle with the doors locked, or a malfunction in an electronic door locking mechanism, or a key breaking off in the lock. In other instances, locked and illegally parked vehicles may have to be entered by police or tow truck operators to enable the vehicle to be towed away. In still other instances, it may be necessary for legal authorities to enter locked vehicles to make legal searches for contraband or explosives, to investigate crimes or in some cases, to enable the automobiles to be moved out of the way of other vehicles in the case of emergencies and natural disasters.

Tools for opening locked vehicle doors are well known and have been in use for a long time. They run the range from a simple bent coat hanger to highly specialized tools such as those formed for a specific vehicle type and model. While a dealer may have access to a set of keys for a particular type of vehicle, it is usually not practical to call a dealer when a vehicle door is locked. More often, an automotive road side service, locksmith, or law enforcement officer responds to such situations and uses tools designed for insertion into the door of the vehicle and interface with the internal locking mechanism to unlock the door. Typically the individuals using such tools have some knowledge of the locking mechanism of a vehicle and some training in using specialized tools in unlocking vehicle doors. A common tool for such door unlocking linkage manipulation known as the "Slim Jim" has been used for many years. By slipping this tool between the doors weather stripping and window, the lock linkage can be manipulated to open the lock.

Over the last few decades, technological advances in cars is making unlocking doors from outside the vehicle more challenging. Improved door construction quality is making it more difficult to insert unlocking tools into the door cavity. Furthermore, adding air bags into the door cavity and additional wiring makes door lock manipulation inside the door cavity more difficult. Some vehicles today employ cables rather than metal rods to operate the lock mechanisms which cannot be effectively operated by unlocking tools. Others may have electrically operated door locks which use electrical switches of some type, including slide switches on the inside door panel or arm rest, or what otherwise appear to be conventional push-pull door lock buttons. With such type of electrically-actuated door locks, there are generally no linkages within the vehicle doors which can be manipulated by any type of externally-inserted mechanical implement. To the contrary, to unlock vehicle doors having electrically-actuated door locks, it is generally necessary to operate the door lock switches on the inside door panels.

In response to such advances and challenges, tools know as "long reach tools" have been developed to work vehicle locking mechanisms inside the passenger compartment rather than from inside the door cavity. One such tool shown in FIG. 1 is a long solid rod 10 having a handle 12 on one end which is grasped by the user to manipulate the rod. The rod has a uniform circular cross section of ¼ inch along its entire length having a bend 14 at the mid-section and a shaped bent tip 16. The entire rod length may be painted with a glow in the dark paint for use at night time or in dark locations. FIG. 2 shows a similar rod 20 as shown in FIG. 1 but which is made of two shorter sections 22 and 24 of the same uniform rod ¼ inch diameter. The two rod sections are coupled together using a large external coupling 26. As shown with more particularity in FIG. 2*a*, each of the mating ends of the two ¼ inch rod sections 22 and 24 are threaded and screwed into an internal female threads of the coupling 26. FIG. 3 shows another similar tool 30, this also having two rods 32 and 34 of the same size. These rod sections 32 and 34 are ⅛th inch in diameter. They are again coupled together by a female coupling indicated by reference number 36.

While unlocking long reach tools described in the above paragraph are desirable, they all have their disadvantages and drawbacks. The tool 10 described in FIG. 1 is very long, typically four feet in length making it costly to ship or mail. Very long boxes are required which significantly adds to the cost of packing and shipping. Such a long tool is also difficult for the user such as roadside service personnel or law enforcement authorities to store and transport in a vehicle for daily use. The tool 20 in FIG. 2 uses a large external coupler 26 which can be difficult to insert between a car door and weather stripping, potentially damaging the car paint or the weather stripping upon insertion between these two structures. This tool 20 and the tool 10 in FIG. 1 are also relatively rigid which, during use to unlock a vehicle door, can damage the door panels, dash board or seats. While the tool 30 in FIG. 3 addresses the desire for a "thin" tool to fit between the door and weather stripping, it is very flimsy and therefore may not possess sufficient strength over its length to transfer sufficient force to open the door locking mechanism. It also has the undesirable coupler.

As such, it is still necessary to have a simple and effective unlocking tool that allows the user to unlock a door in a short time thus allowing the user to proceed to assist others.

SUMMARY OF THE INVENTION

The invention is directed to a tool for use in unlocking a vehicle door. The tool may comprise a first rod section having a first stiffness and a second rod section having a second stiffness. The first stiffness of the first rod section is greater than the second stiffness of the second rod section. Various materials, sizes and shapes for the rod sections may be selected to achieve a desired stiffnesses for each rod section. For example, the first and second rod sections may have a circular cross-section, the cross-section of the first rod section being larger than the cross-section of the second rod section. More particularly, the first rod section may have a circular cross section of about ¼ inch diameter while the second rod section may have a circular cross-section of about ⅛th inch in diameter, for example. The second rod section may be made of steel rod material that provides a desired flexibility for working with the interior of the vehicle and can be bent to a desired shape. Coupling means are provided for coupling the first rod section to the second rod section, thereby forming an elongated tool for reaching into the interior compartment of a vehicle to manipulate the locking actuators or door handle. A preferred means for coupling the rods comprises a threaded hole in an end of the first rod section and a threaded end portion on the second rod section. The second rod section can simply be screwed into the end of the first rod section to assemble the vehicle unlocking tool. The first rod section may have a handle to aid in manipulating the rod in use. The end of the second rod section can have different configuration such as a 90 degree depending leg or a U-shaped leg, for example, depending on the specific needs for the particular vehicle lock mechanism. The end of the second rod section may also have a glow in the dark cap to visually aid the operator looking into the vehicle compartment from the outside of the vehicle.

In a variation of the vehicle door unlocking tool, a third rod section may be added for coupling between the first rod section and the second rod section to extend the reach of the tool. The stiffness of the third rod section is preferably substantially equal to the stiffness of the first rod section.

A vehicle unlocking tool kit can be put together from the rod sections described above. For example, the tool kit may include a first rod section with handle, and two or more second rod sections having different end configurations. The different second rod sections can be selectively screwed onto the first rod section depending on the specific car and function to be performed. A third rod section can be added to the kit for coupling between the first and second rod sections, thereby extending the overall reach of the tool, as needed. Such a vehicle unlocking too kit can be carried in a compact outfit and provide sufficient tooling flexibility for the operator to unlock a wide variety of vehicles.

There is thereby provided an effective, yet relatively inexpensive tool for the keyless unlocking of locked automobile doors from the outside when the door windows are closed, and for performing such unlocking operation without damage to the automobile door or interior.

Other advantages and features of the present invention will become apparent for the following detailed description of the invention, from the claims and the accompanying drawings.

DESCRIPTION OF THE PREFERRED EMBODIMENT

Figure 1:
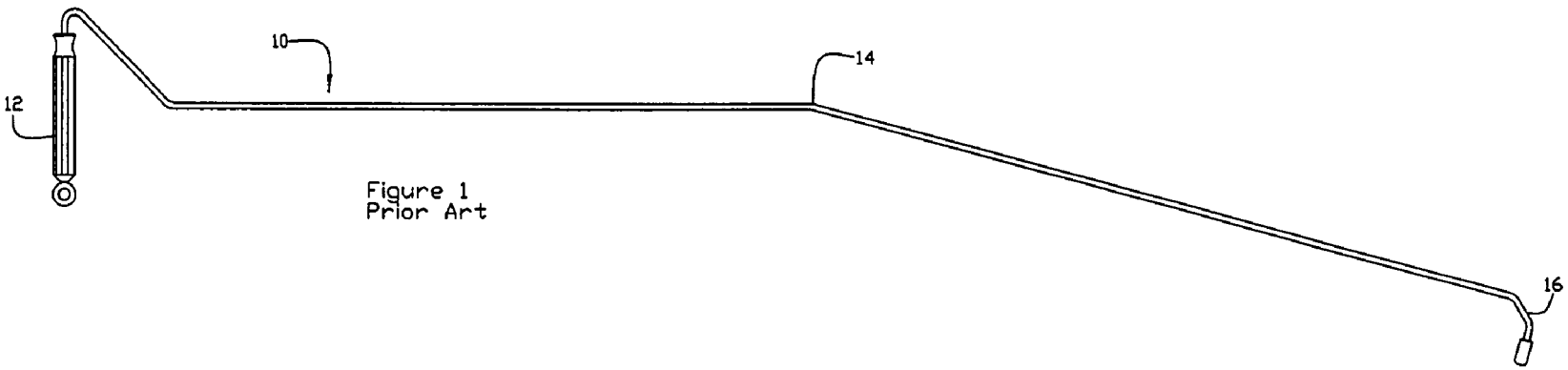
Figure 1 Prior Art
FIG. 1 is a front view of a prior art lock opening tool.
Figure 2:
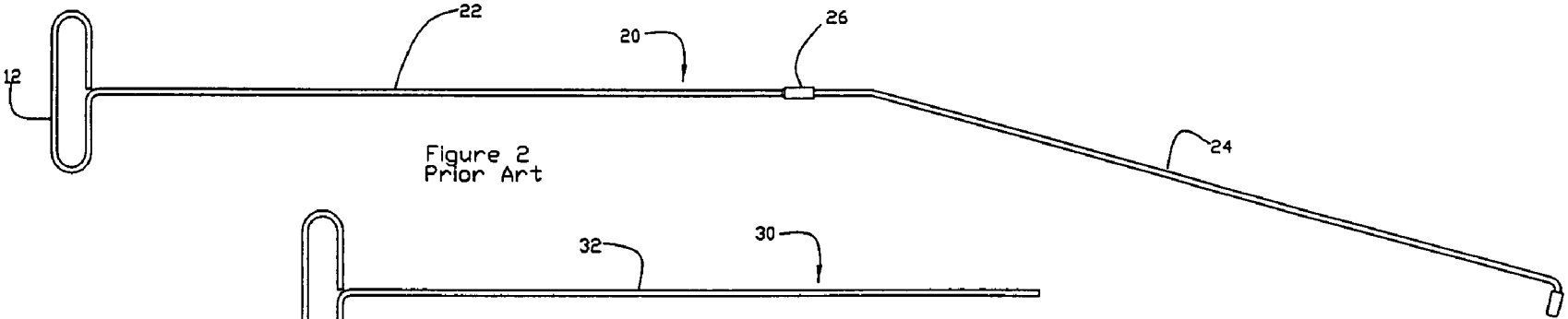
Figure 2 Prior Art
FIG. 2 is a front view of another prior art lock opening tool.
Figure 3:
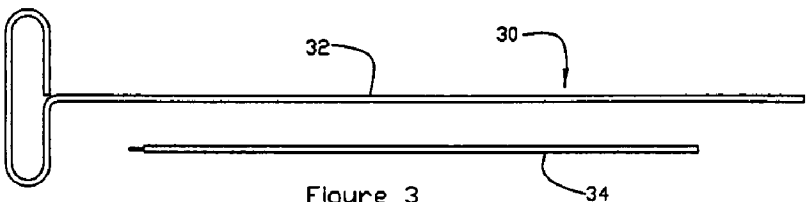
Figure 3 Prior Art
FIG. 3 is a front view of yet another prior art locking opening tool.
Figure 2A:
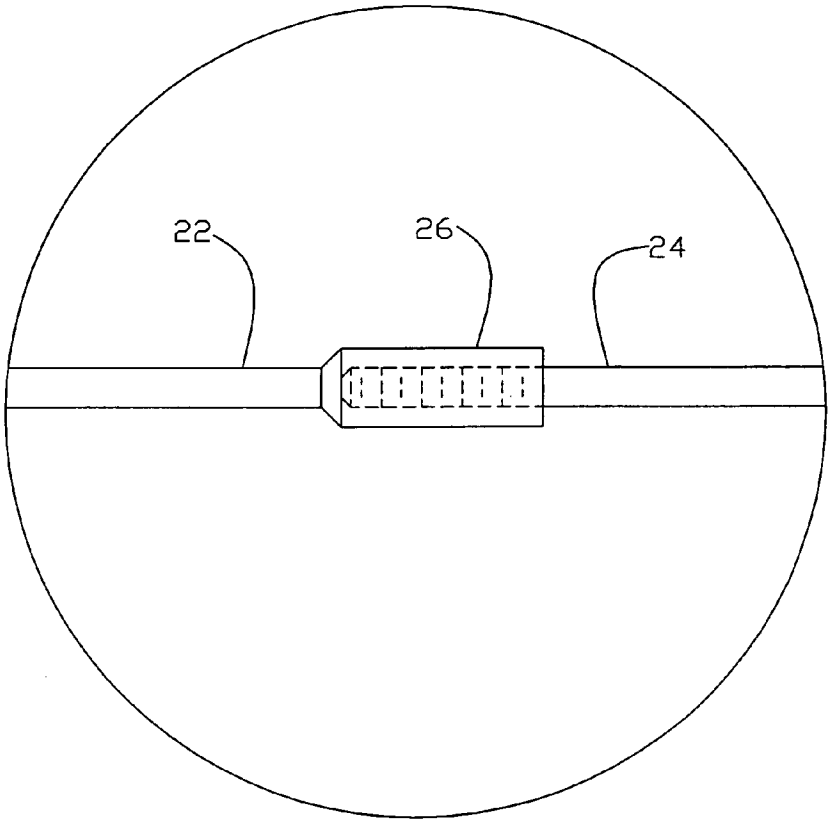
Figure 2a Prior Art
FIG. 2*a* is an enlarged view of the female coupler used to couple the rods shown in FIG. 2.
Figures 4, 4A, 5:
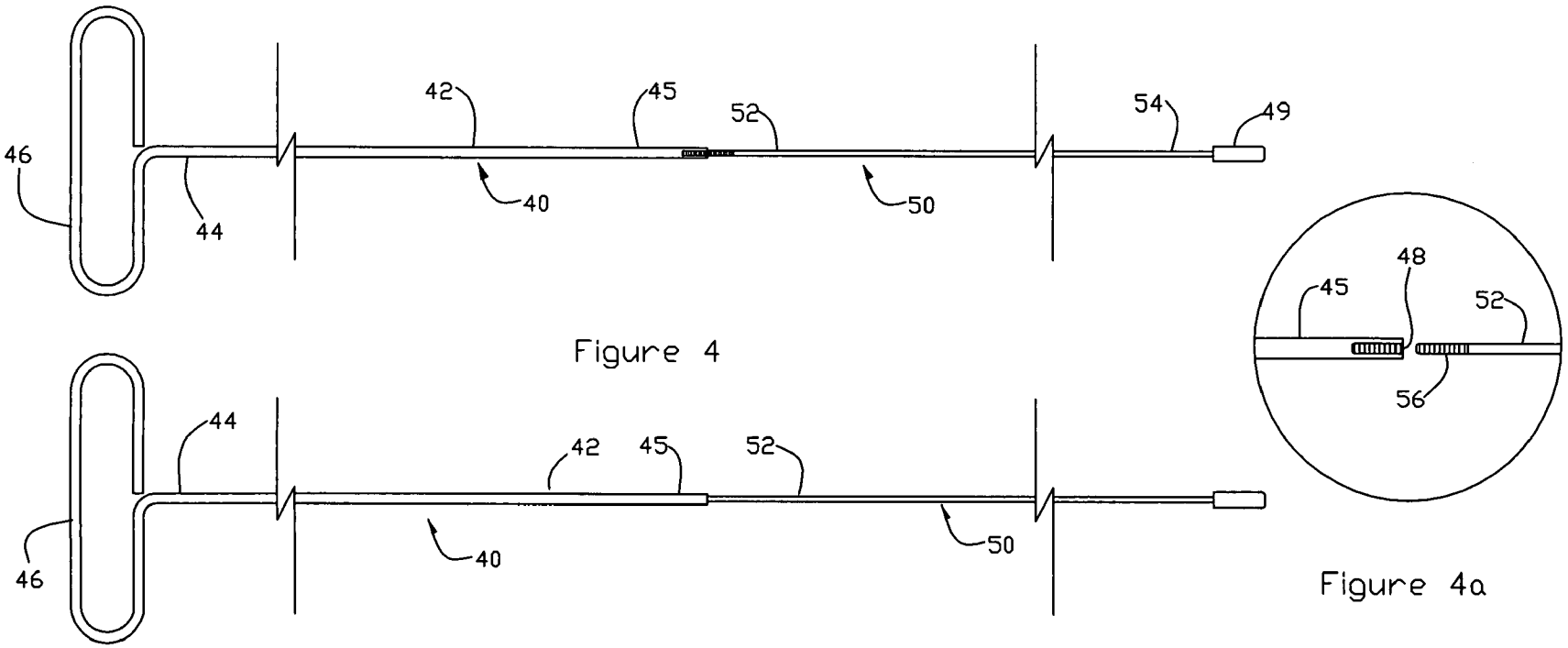
FIG. 4 is a front view showing the two unassembled rod sections of a vehicle unlocking tool in accordance with the present invention.
FIG. 4*a* is an enlarged view showing one mechanism for coupling the two rod sections shown in FIG. 4.
FIG. 5 is a front view showing the two rod sections of FIG. 4 assembled.

Referring in greater detail to the drawings, there is shown in FIG. 4 a vehicle unlocking tool 40 embodying the principles of the invention. Tool 40 comprises two rod sections, a first rod section 42 having two ends 44 and 45 and a second rod 50 section having two ends 52 and 54. On the first rod section 42, at the operator end 44, a handle 46 has been formed that can be grasped by the operator. At the other end 45 there is a co-linear female threaded hole 48, shown with more particularity in FIG. 4*a*. The second rod section 50 has a threaded male end portion 56 at one end 52. The other end of this rod has a rubber tip 49, which maybe made of glow in the dark material. The other end 54 which will be used to manipulate a lock actuator may have various configurations as illustrated below, but in this example simply terminates.

To assemble the first and second rod sections, the threaded male end portion 56 of the second rod section 50 is screwed into the threaded female hole 48 of the first rod section 42. An elongated vehicle unlocking tool 40 is thereby formed as shown in FIG. 5. The rod materials, shapes and sizes for the first and second rod sections are selected so that the first rod section 42 has a stiffness greater than the second rod section 50. This can be accomplished by selecting a diameter for the first rod section that is larger than the diameter of the second rod section. As an example, a steel rod having a circular cross-section of ¼ inch diameter may be used for the first rod section and a steel rod having a circular cross-section of ⅛th inch may be used for the second rod section. The first and second rod sections each may be about 26 inches long, for example, which combine to form a rod that is about 52 inches long, which has sufficient reach into a vehicle compartment for many unlocking scenarios. In use, the first rod section 42 will seat between the door frame and car body or window and car body which are separated by a wedge tool and it is preferable that this first rod section be relatively stiff; while the second rod section will be used to manipulate the lock actuators inside the vehicle compartment and is therefore preferably somewhat resilient, can substantially retain its shape, is flexible and can transmit enough force to open a locking mechanism or operate a door handle without damaging the interior of the vehicle.

Figure 6A:
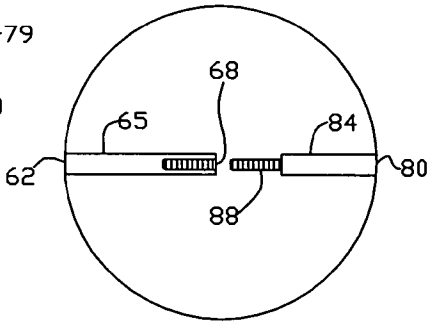
FIGS. 6*a* and 6*b* are enlarged views showing one mechanism for coupling the rod sections of FIG. 6.
Figure 6B:
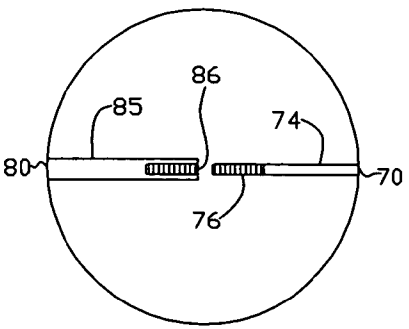
Figure 6:
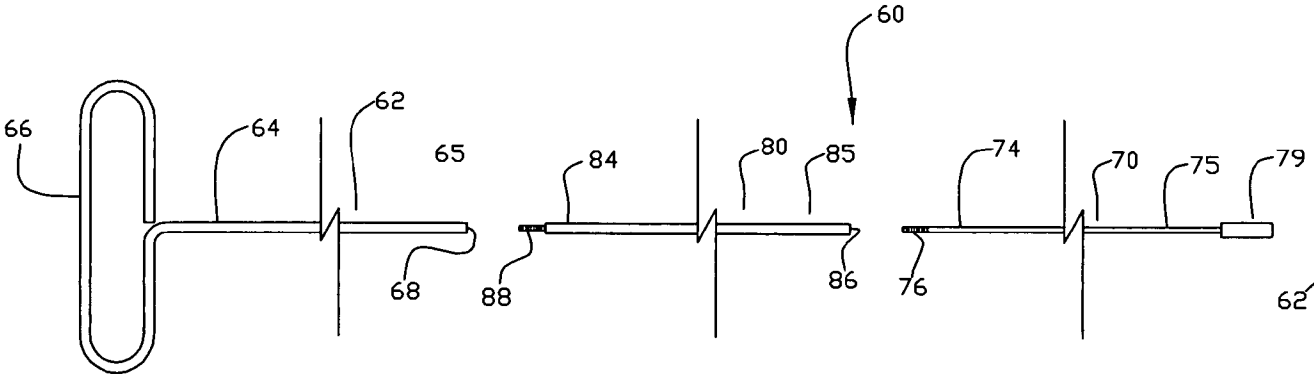
FIG. 6 is a front view showing the three unassembled rod sections of a vehicle unlocking tool.
Figure 7:
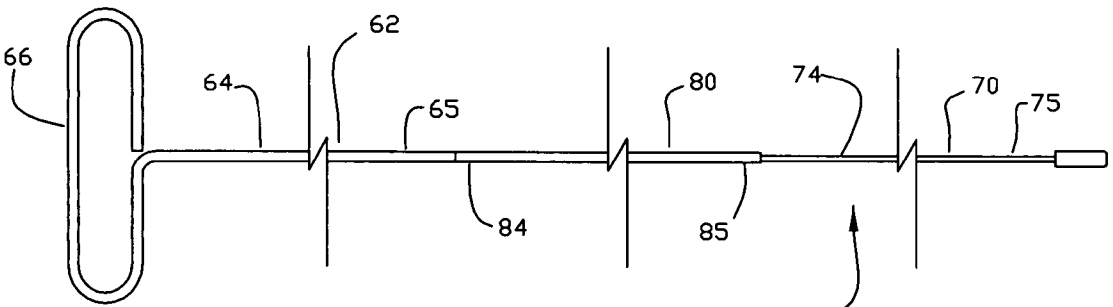
FIG. 7 is a front view showing the three rod sections of FIG. 6 assembled.

Another embodiment of the invention for a vehicle unlocking tool is illustrated in FIGS. 6 and 7. Tool 60 comprises three rod sections, a first rod section 62 having two ends 64 and 65, a second rod section 70 having two ends 74 and 75, and a third rod section 80 having two ends 84 and 85. On the first rod section 62, at the operator end 64, is a loop handle 66 that can be grasped by an operator. At the other end 65 is a co-linear threaded hole 68 shown with more particularity in FIG. 6*a*. The second rod section 70 has a threaded end portion 76 at one end 74. The other end 75 may have a rubber tip 79 which may be made of glow in the dark material. The third rod section 80 has a co-linear female threaded hole 86 at one end 85 shown with more particularity in FIG. 6*b* and a threaded end portion 88 at the other end 84.

The three rod sections described above with reference to FIG. 6 are assembled by screwing the threaded end portion 88 of the third rod section 80 into the threaded hole 68 of the first rod section 62 and by screwing the threaded end portion 76 of the second rod section 70 into the threaded hole 86 of the third rod section 80 thereby forming the elongated vehicle unlocking tool shown in FIG. 7. The materials, sizes and shapes of the three rods are preferably selected so that the first rod section and the third rod section have a stiffness greater than the second rod section. This can be accomplished by selecting a rod diameter for the first rod section and third rod section that is larger than the diameter of the second rod section. As an example, steel rods having a circular cross-section of ¼ inch diameter may be used for the first rod section and third rod section and a steel rod having a circular cross-section of ⅛th inch diameter may be used for the second rod section. The first and second rod sections each may be about 52 inches long and the third rod section may be about 18 inches long.

Figure 8A:
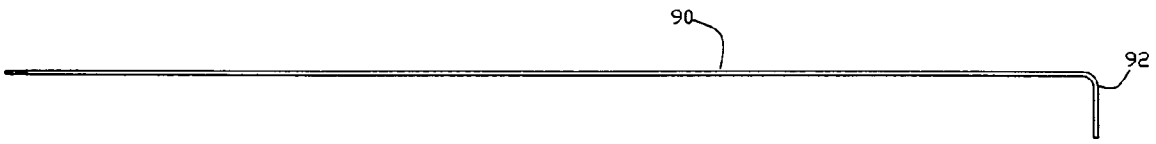
FIGS. 8*a* through 8*c* illustrate various shapes for the distal rod sections of FIGS. 4 and 6.
Figure 8B:
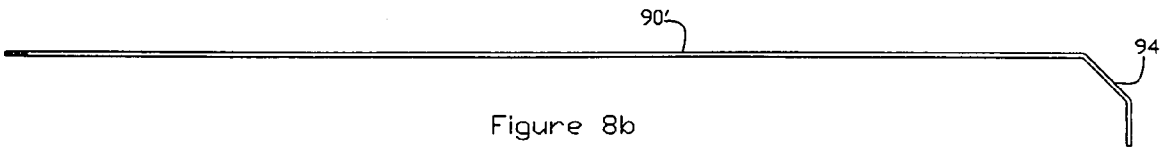
Figure 8C:
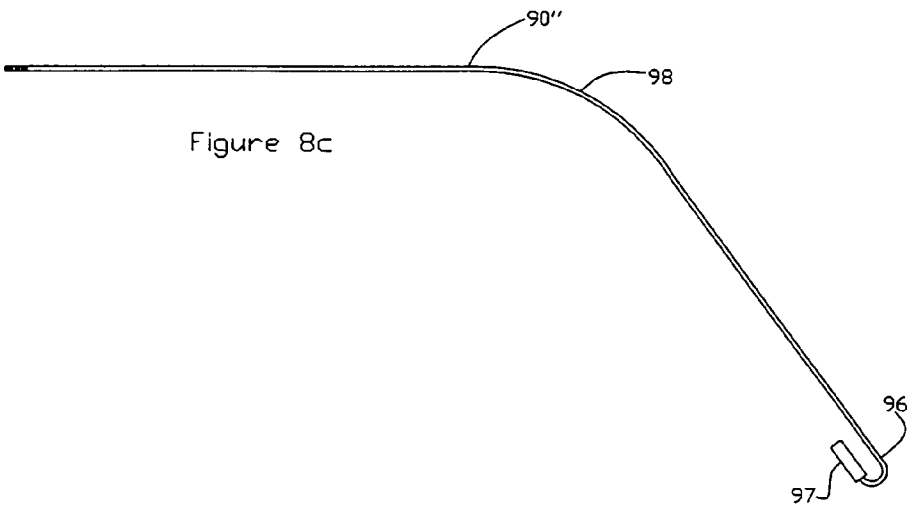

FIG. 8 illustrates three examples of possible second rod sections or end rod sections which could be attached and used as the end rod section with either the first or third rod section of the two above described embodiments. Depending on the vehicle and the layout of the interior compartment and location of the locking actuators various end configurations may be needed to perform the unlocking task. In FIG. 8*a*, the end rod section 90 is shown having a short depending right angle dog leg 92. In FIG. 8*b*, the end rod section 90' is shown having a two short angled depending dog legs 94. In FIG. 8*c*, the end rod section 90" is shown having a U-shaped bend 96. The end of this rod may have a glow in the dark end cap 97. The overall shape of the end rod can also take different shapes as shown in FIG. 8*c* with end rod 90" have an arcuate bend 98. Advantageously, the second rod size, shape and material can be selected such that it may be bent by the operator on location into different configurations including those illustrated in FIGS. 8*a* through 8*c*.

Figure 9:
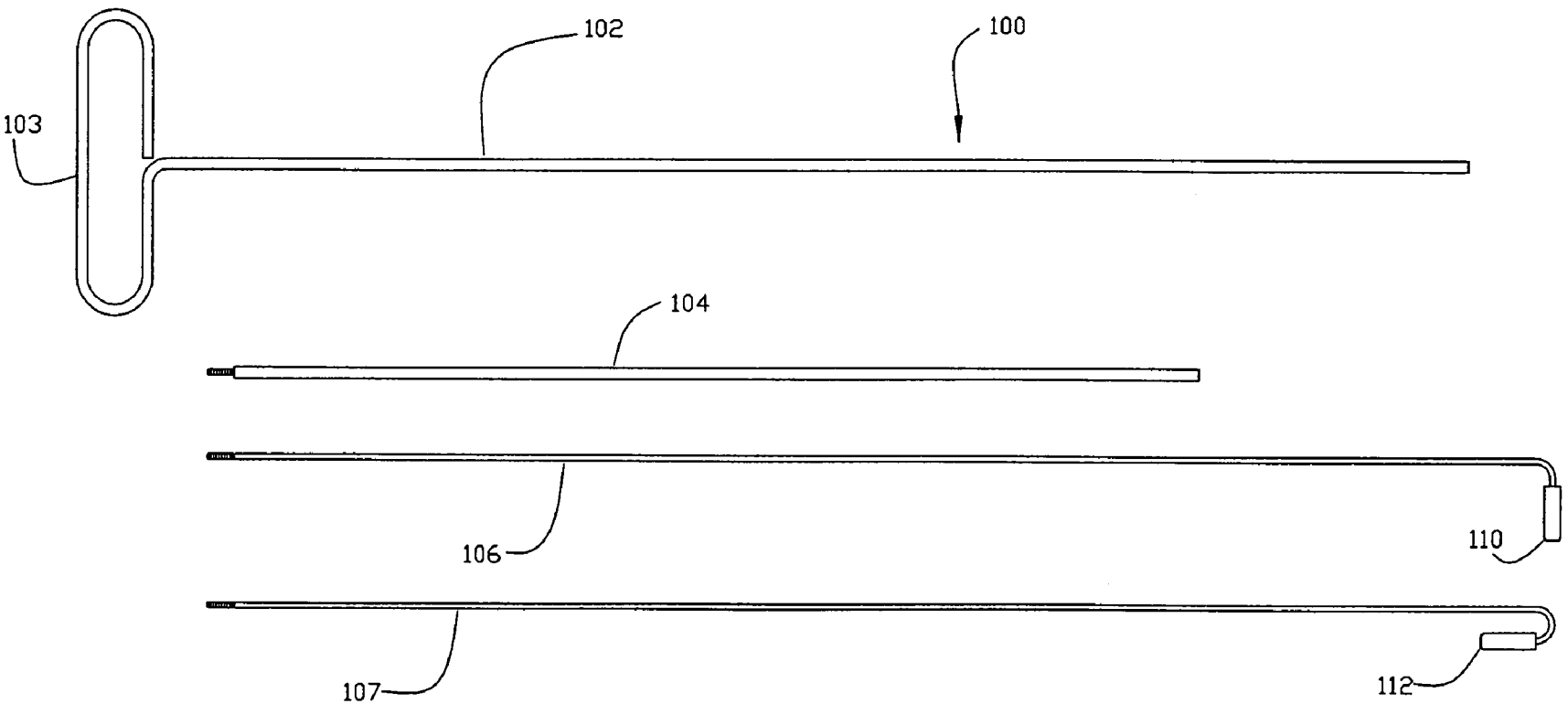
FIG. 9 is a front view of a possible vehicle unlocking tool kit that is readily portable and transportable.

The invention lends itself readily to provide a convenient kit with optional rod sections that can be assembled to meet a variety of unlocking situation presented by different vehicles. For example, a vehicle unlocking tool kit 100 illustrated in FIG. 9 may contain a first rod section 102, third rod 104 and two second rod section 106 and 107. The first rod section 102 can be used with either of the two second rod sections 106 or 107 which have different end configurations 110, 112 for use with different car lock configurations. If a longer reach is needed to access the lock actuators in a vehicle, the third rod section 104 may be screwed in place between the first and second rod sections increasing the overall length of the tool. With such a kit, an operator can unlock many different vehicles. Since the assembled rod breaks down into smaller segments it can be stored after use in the operators vehicle and easily transported.

While the present invention has been described in regards to a preferred embodiment, it is understood that various modifications may be made by those skilled in the art without departing from the scope or spirit of the invention as identified in the appended claims.

For example, while embodiments for a two piece and three piece vehicle unlocking tool have been illustrated above, any number of rod sections is envisioned by the invention. Furthermore, while rod sections of different sizes have been illustrated to built a elongated unlocking tool, the rod sections could be similar or could have various cross-sectional shapes, also various sizes, lengths, bend configurations and coupling arrangements.

What is claimed is:

1. A tool for opening a locked vehicle door, comprising:

a first rod section having a first stiffness, the first rod section having two ends with a handle at one end and a co-linear female threaded hole at the other end;

a second rod section having a second stiffness, the second rod section having two ends with a threaded male portion at one end and a co-linear female threaded hole at the other end;

a third rod section having a third stiffness, the third rod section having two ends with a threaded male portion at one end and a lock actuator manipulating portion at the other end, the threaded male portion of the second rod section being removably screwed into the co-linear female threaded hole of the first rod section and the threaded male portion of the third rod section being removably screwed into the co-linear female threaded hole of the second rod section, and the stiffness of the first rod section and second rod section being the same but greater than the third stiffness of the third rod section, and wherein the first, second and third rod sections have circular cross-sections, the diameter of the first and second rod sections being the same but greater than the diameter of the third rod section.

2. The tool for opening a locked vehicle door as claimed in claim 1 wherein the first and second rod section has a diameter of about ¼th inch and the third rod section has a diameter of about ⅛th inch.

3. The tool for opening a locked vehicle door as claimed in claim 2 wherein the third rod section is made of steel such that the lock actuator manipulating portion at the other end of the third rod section can be bent into different configurations for working different lock arrangements.

4. The tool for opening a locked vehicle door as claimed in claim 3 wherein the lock manipulating portion at the other end of the second rod section has a glow in the dark cap.

5. A method for opening a locked vehicle door comprising the steps of:

providing a tool including a first rod section having a first stiffness, the first rod section having two ends with a handle at one end and a co-linear female threaded hole at the other end, and a second rod section having a second stiffness, the second rod section having two ends with a threaded male portion at one end and a lock actuator manipulating portion at the other end, the threaded male portion of the second rod section being removably screwed into the co-linear female threaded hole of the first rod section, and the stiffness of the first rod section being greater than the second stiffness of the second rod section, wherein the first and second rod sections have a circular cross-section, the diameter of the first rod section being larger than the diameter of the second rod section, reaching into an interior compartment of the vehicle, and using the lock actuator manipulating portion to manipulate a locking mechanism or a door handle of the vehicle to unlock the door.

6. The method as claimed in claim 5 wherein the first rod section has a diameter of about ¼th inch and the second rod section has a diameter of about ⅛th inch.

7. The method as claimed in claim 6 wherein the second rod section is made of steel such that the lock actuator manipulating portion at the other end of the second rod section can be bent into different configurations for working different lock arrangements.

8. The method as claimed in claim 6 wherein the lock actuator manipulating portion at the other end of the second rod section has a glow in the dark cap.

* * * * *